United States Patent [19]

Lee et al.

[11] 3,974,906

[45] Aug. 17, 1976

[54] ENDLESS LOOP RIBBON CARTRIDGE WITH RANDOM STORAGE

[75] Inventors: Sen Lin Lee, Oakland; Ernst Peter Hess, Castro Valley, both of Calif.

[73] Assignee: Xerox Corporation, Stamford, Colo.

[22] Filed: Feb. 25, 1972

[21] Appl. No.: 229,396

[52] U.S. Cl. ..... 197/168; 197/151

[51] Int. Cl.[2] ..... B41J 33/10

[58] Field of Search ..... 197/168, 151

[56] References Cited

UNITED STATES PATENTS

| | | | |
|---|---|---|---|
| 539,683 | 5/1895 | Johns | 197/168 |
| 764,342 | 7/1904 | Booth | 197/168 |
| 1,063,289 | 6/1913 | Ruffin et al. | 197/168 |
| 2,685,357 | 8/1954 | Koreska | 197/168 |
| 2,755,905 | 7/1956 | Segui | 197/168 |
| 3,621,968 | 11/1971 | Kondur | 197/151 |
| 3,726,381 | 4/1973 | Murphy | 197/168 |

FOREIGN PATENTS OR APPLICATIONS

| | | | |
|---|---|---|---|
| 12,870 | 7/1914 | United Kingdom | 197/168 |
| 29,235 | 5/1914 | United Kingdom | 197/168 |

*Primary Examiner*—E. H. Eickholt

*Attorney, Agent, or Firm*—John E. Beck; Terry J. Anderson; Leonard Zalman

[57] ABSTRACT

A ribbon cartridge for a printer provides an unsupported length of ribbon between a pair of spaced guide means to provide for easy threading. In addition, continuous rotation of the ribbon is made possible by storing the ribbon as an endless loop in a random fashion in the principal cavity of the cartridge. A secondary cavity prevents an accidental loop from coming out of the cartridge which would otherwise result in slack in the unsupported length.

3 Claims, 6 Drawing Figures

FIG_2
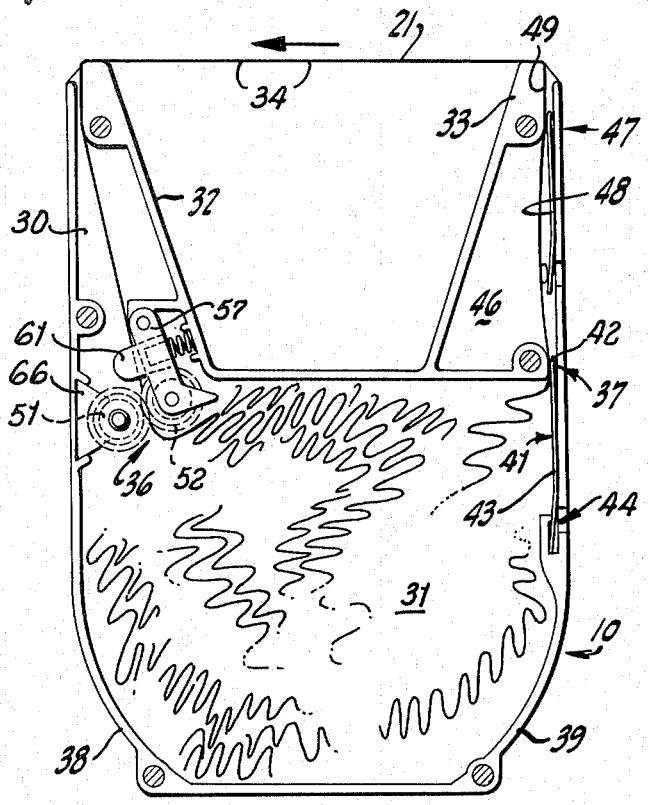
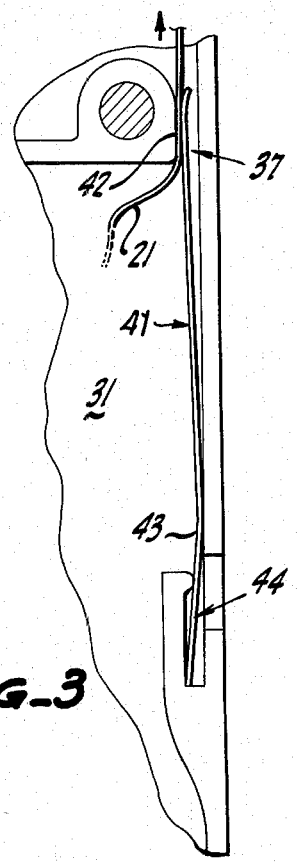
FIG_3
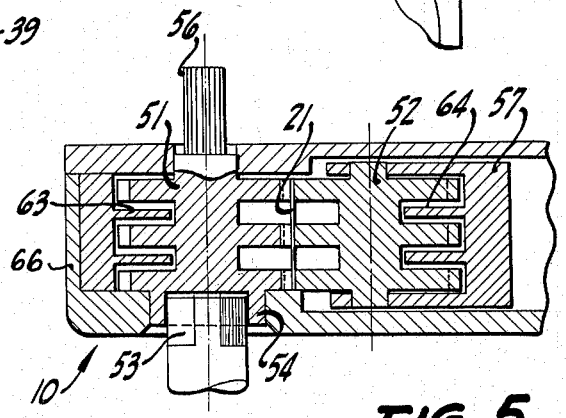
FIG_5
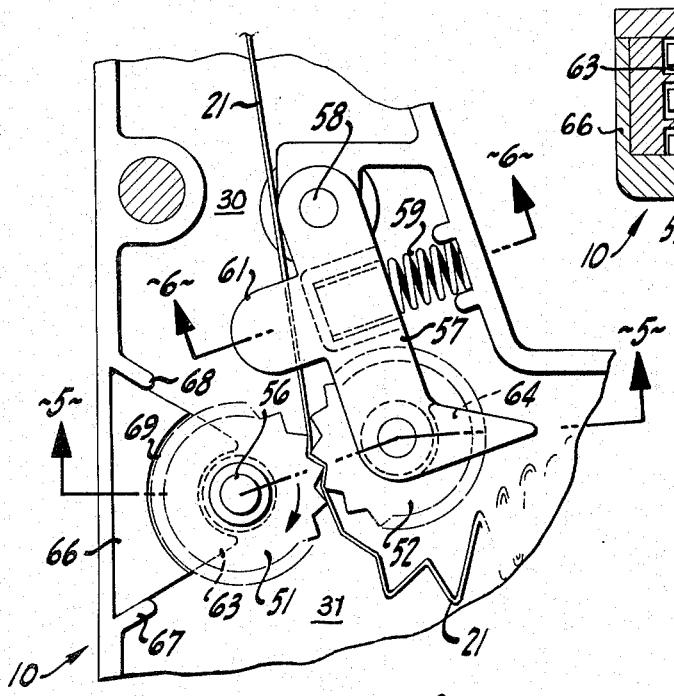
FIG_4
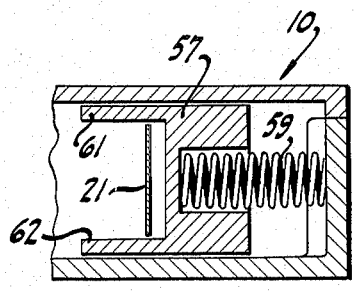
FIG_6

ENDLESS LOOP RIBBON CARTRIDGE WITH RANDOM STORAGE

BACKGROUND OF THE INVENTION

The present invention is directed to a ribbon cartridge for a high-speed printer.

In providing a ribbon for a high-speed printer it is desirable to provide one which requires no threading or reversing. While an endless loop eliminates the problem of reversal, the principle of the eight track magnetic tape cartridge is not usable because of excessive friction.

OBJECT AND SUMMARY OF THE INVENTION

It is, therefore, an object of the present invention to provide a ribbon cartridge which requires no threading and no reversal of ribbon while still providing low friction.

In accordance with the above object there is provided a ribbon cartridge for a printer comprising an endless loop of ribbon. A principal cavity stores the ribbon in a random manner. The cavity has a depth substantially equal to the width of the ribbon and entrance and exit ports for the ribbon. A secondary cavity receives the ribbon from the principal cavity through the exit port. Such exit port includes frictional drag means for retarding the exit of the ribbon. A pair of spaced guide members provide an unsupported length of the ribbon external of the cartridge. The entrance port of the principal cavity includes a pair of pinch rollers for receiving the ribbon from one of the guide members and pushing the ribbon into the principal cavity. The secondary cavity has an exit port for supplying ribbon to the other of the guide members. This exit port includes frictional drag means for retarding the exit of the ribbon.

BRIEF DESCRIPTION OF THE DRAWING

FIG. 2 is a plan view of the cartridge with the top removed;

FIG. 3 is an enlarged view of a portion of FIG. 2;

FIG. 4 is an enlarged view of another portion of FIG. 2;

FIG. 5 is a cross-sectional view taken along the line 5—5 of FIG. 4; and

FIG. 6 is a cross-sectional view taken along the line 6—6 of FIG. 4.

DETAILED DESCRIPTION OF THE PREFERRED EMBODIMENT

Figure 1:
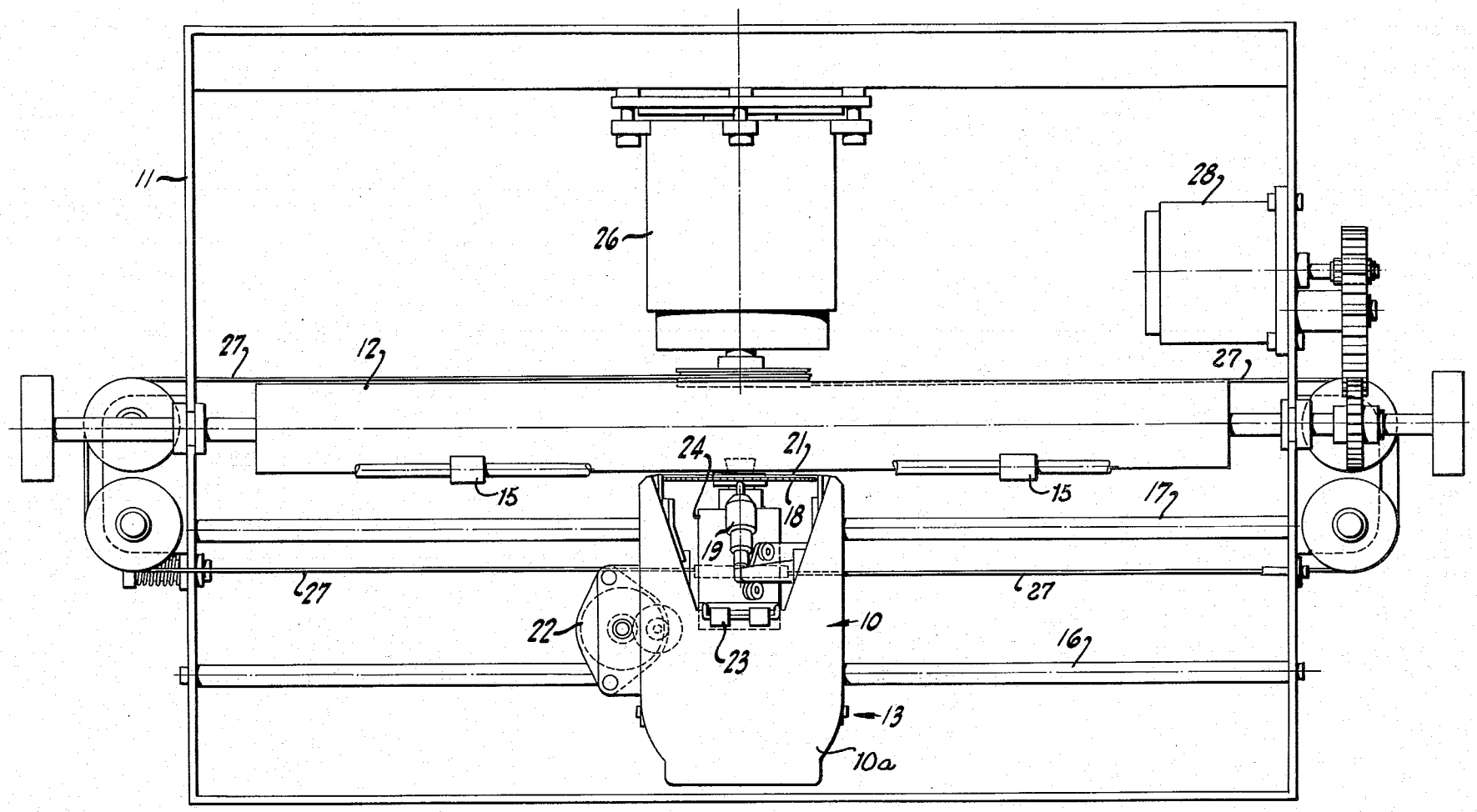
FIG. 1 is a plan view of a printer with the ribbon cartridge of the present invention mounted thereon.

FIG. 1 illustrates the ribbon cartridge 10 of the present invention as it would be mounted in conjunction with a high-speed printer. In general, the printer includes a frame 11 on which is mounted a platen 12 for receiving the paper (not shown) to be printed upon which passes between platen 12 and rollers 15. Ribbon cartridge 10 itself is mounted for transverse movement with relation to platen 12 on a carriage 13 which is movable on the rods 16 and 17. Carriage 13, in addition to ribbon cartridge 10, includes a rotary printing wheel 18 on which type elements are mounted on the end of the individual spokes, and a hammer assembly 19 for striking a selected type element. The ribbon 21 of ribbon cartridge 10 is interposed between the printing wheel 18 and platen 12. Ribbon 21 is indexed intermittently or stepped by a stepping motor 22 carried by carriage 13. The cartridge 10 is retained on the carriage 13 by the rubber rollers 23.

Still referring to the overall printer mechanism the printing wheel 18 is driven by a servo controlled motor 24. The carriage 13 itself is transported by a second servo controlled motor 26 mounted on frame 11. The motor 26 is coupled to the carriage 13 by an endless cable 27. A stepping motor 28 coupled to platen 12 provides for paper feed.

FIG. 2 shows cartridge 10 with its top cover **10*a* removed. As is apparent, ribbon 21 is stored in a principal cavity 31 in a random fashion. This cavity 31 has a depth which is substantially equal to the width of the ribbon 21. Cartridge 10 includes a pair of spaced integral guide members or appendages 32 and 33 which provide an unsupported length 34 of the ribbon 21 external of the cartridge 10. This unsupported length 34 is in use inserted, referring to FIG. 1, between the printing wheel 18 and the platen 12** which would have paper wrapped thereon. No threading is necessary.

Principal cavity 31 has an entrance port generally indicated at 36 and an adjacent exit port generally indicated at 37. The cavity 31 itself is substantially square shaped and the other two corners 38 and 39 being rounded to prevent jamming of the ribbon 21 due to a pressure build-up at these points of the randomly loaded ribbon 21.

Exit port 37 is shown in greater detail in FIG. 3 where the ribbon 21 has its motion, shown by the arrow, retarded by a leaf spring 41 which presses the ribbon 21 against the surface 42 which is formed from a portion of the wall of cavity 31. Leaf spring 41 is biased toward wall 42 by its bend at 43 and its mounting at 44 in the wall of cavity 31.

A secondary cavity 46 is provided in cartridge 10 which receives the ribbon 21 from the exit port 37. Secondary cavity 46 is significantly smaller in size but still has a width substantially equal to that of the ribbon 21. It includes an exit port 47 for supplying ribbon 21 to the guide member 33 and includes frictional drag means with a spring 48 and a surface 49 similar to that of the principal cavity's exit port 37. The function of the secondary cavity 46 is in case a loop of ribbon 21 is inadvertently drawn through exit port 37 this loop will be dissipated in cavity 46 because of the additional frictional drag provided at exit port 47. Thus, the unsupported length 34 of the ribbon 21 will be maintained in a taut condition which, of course, is necessary for accurate printing.

FIG. 4 illustrates a pair of pinch rollers 51, 52 for receiving ribbon 21 from the guide member 32 through a secondary cavity 30 and pushing it into principal cavity 31. FIG. 5 also illustrates the pinch rollers 51 and 52 in cross section. The rollers 51 and 52 are formed by spaced discs having serrated edges to maintain good frictional contact with the ribbon 21. Roller 51 is the drive roller and as best illustrated in FIG. 5 includes a star type coupling 53 which is coupled to drive motor 22 (FIG. 1). Roller 51 is mounted for rotation in the base of the cartridge 10 as illustrated at 54. Knurled knob 56 extends from the other end of roller 51 through the top of the cartridge 10 to provide for manual winding of the ribbon 21 in case of malfunction. Pinch roller 52 is pivotally mounted for rotation on an arm 57 which is pivoted on the cartridge frame at 58 and biased toward roller 51 by a spring 59. Arm 57 includes a pair of spaced parallel guide members 61 and 62 for guiding ribbon 21 into the pinch rollers 51, 52.

In order to prevent the ribbon 21 which has been pushed into cavity 31 from being accidently engaged with pinch rollers 51 and 52 they are also provided as best shown in FIG. 5 with fingerlike cam surfaces 63 interleaved between the spaced discs of the pinch roller 51 and fingerlike cam surfaces 64 interleaved between the spaced discs of the pinch roller 52.

In the case of the surfaces 64, these extend from the arm 57. Fingerlike cam surfaces 63 are actually a portion of a wedge shaped assembly 66 which is fitted into the wall of cartridge 10 by angled fingers 67 and 68 and against which the serrated edges of pinch roller 51 is rotated at 69.

Thus, the present invention provides an improved cartridge for a ribbon of a high-speed printer which requires no threading because of the unsupported length of ribbon provided by the spaced guide members and also no reversal due to the endless loop nature of the ribbon. Moreover, this endless loop is made possible by the random storage of the ribbon along with the secondary storage cavity to prevent slack in the unsupported portion of the ribbon.

We claim:

1. A ribbon cartridge for a printer comprising:

a housing having a main body portion and first and second generally opposed spaced appendage portions extending from said main body portion, each of said first and second appendage portions having generally opposed wall portions extending from said main body portion, the distance between one of said wall portions of said first appendage portion and an opposed one of said wall portions of said second appendage portion increasing as the distance from said main body portion increases;

a principal cavity within said main body portion of said housing for storing a portion of an endless loop of ribbon in a random manner, said principal cavity having a primary ribbon exit port and a primary ribbon entrance port;

a small cavity within said first appendage portion of said housing at least partially defined by said generally opposed wall portions of said first appendage portion, said small cavity communicating with said principal cavity through said primary ribbon exit port and communicating with the exterior of said housing through a secondary ribbon exit port, said primary ribbon exit port including tensioning means for engaging a planar surface of said ribbon;

guide means forming an integral part of said first and second appendage portions for providing a path of travel for said ribbon between said first and second appendage portions in an unsupported length, said path of travel for said ribbon between said first and second appendage portions being in a plane extending between said first and second appendage portions;

a small cavity within said second appendage portion, said small cavity within said second appendage portion communicating with said principal cavity through said primary ribbon entrance port, said primary ribbon entrance port including drive means for engaging opposite surfaces of said ribbon for advancing said ribbon along said path of travel defined by said guide means when said cartridge is operatively positioned in said printer.

2. The cartridge of claim 1 wherein said tensioning means includes frictional drag means, and said drive means includes a first pinch roller and a second pinch roller spring-biased against said first pinch roller.

3. A ribbon cartridge for a printing device comprising:

a housing having a main body portion and first and second generally opposed spaced appendage portions extending from said main body portion, each of said first and second appendage portions having wall portions extending from said main body portion, the distance between one of said wall portions of said first appendage portion and an opposed one of said wall portions of said second appendage portion increasing as the distance from said main body portion increases, a principal cavity within said main body portion of said housing for storing a portion of an endless loop of ribbon in a random manner, said principal cavity having a primary ribbon exit port and a primary ribbon entrance port;

a first small cavity within said first appendage portion of said housing at least partially defined by said generally opposed wall portions of said first appendage portion, said first small cavity communicating with said principal cavity through said primary ribbon exit port and communicating with the exterior of said housing through a secondary ribbon exit port;

said primary ribbon exit port including a first spring member for engaging said ribbon against a surface adjacent said first spring member, said secondary ribbon exit port including a second spring member for engaging said ribbon against a surface adjacent said second spring member, said first and second spring members being positioned adjacent a common wall of said housing such that said ribbon follows a substantially straightline path while in said first small cavity;

guide means formed as an integral part of each of said first and second appendage portions for providing a path of travel for said ribbon between said first and second appendage portions in an unsupported length, said path of travel for said ribbon between said first and second appendage portions being in a plane the lateral direction of which is generally parallel to the lateral direction of said ribbon in said principal cavity, said path of travel being displaced from said principal cavity by at least the distance between said primary ribbon exit port and said secondary ribbon exit port; and a second small cavity within said second appendage portion, said second small cavity communicating with said principal cavity through said primary ribbon entrance port, said primary ribbon entrance port including drive means having a first pinch roller and a second pinch roller springbiased against said first pinch roller, said first and second pinch rollers engaging opposite surfaces of said ribbon for advancing said ribbon along said path of travel defined by said guide means when said cartridge is operatively positioned in said printing device.

* * * * *